US009527046B1

(12) United States Patent
Roe

(10) Patent No.: US 9,527,046 B1
(45) Date of Patent: Dec. 27, 2016

(54) SYSTEM AND METHOD FOR STABLY INFUSING GAS INTO LIQUID, AND METHODS OF USING THE GAS INFUSED LIQUID

(71) Applicant: Cliffton Lee Roe, Harrison Township, MI (US)

(72) Inventor: Cliffton Lee Roe, Harrison Township, MI (US)

( * ) Notice: Subject to any disclaimer, the term of this patent is extended or adjusted under 35 U.S.C. 154(b) by 0 days.

(21) Appl. No.: 14/991,534

(22) Filed: Jan. 8, 2016

(51) Int. Cl.

| | |
|---|---|
| ***B01F 3/04*** | (2006.01) |
| ***B01F 5/04*** | (2006.01) |
| ***B01F 15/00*** | (2006.01) |
| ***B01F 15/02*** | (2006.01) |
| ***B01F 5/00*** | (2006.01) |

(52) U.S. Cl.
CPC ..... *B01F 3/0446* (2013.01); *B01F 3/04056* (2013.01); *B01F 5/00* (2013.01); *B01F 5/04* (2013.01); *B01F 15/00162* (2013.01); *B01F 15/00344* (2013.01); *B01F 15/0243* (2013.01); *B01F 15/0254* (2013.01)

(58) Field of Classification Search
CPC ..... B01F 3/04; B01F 3/04007; B01F 3/04021; B01F 3/04049; B01F 3/04056; B01F 5/00; B01F 5/04; B01F 2005/0008; B01F 2005/0022
USPC ..... 261/31, 76, 115, 117
See application file for complete search history.

(56) References Cited

U.S. PATENT DOCUMENTS

| | | | |
|---|---|---|---|
| 3,748,828 | A | 7/1973 | Lefebvre |
| 4,192,742 | A | 3/1980 | Bernard et al. |
| 4,788,020 | A | 11/1988 | Yampolsky et al. |
| 5,403,473 | A | 4/1995 | Moorehead et al. |
| 6,209,855 | B1 | 4/2001 | Glassford |
| 6,689,262 | B2 | 2/2004 | Senkiw |
| 7,008,535 | B1 | 3/2006 | Spears et al. |

(Continued)

FOREIGN PATENT DOCUMENTS

| | | | |
|---|---|---|---|
| GB | 517550 | A | 2/1940 |
| WO | 2014/075191 | A1 | 5/2014 |
| WO | 2015/073345 | A1 | 5/2015 |

OTHER PUBLICATIONS

Watanabe et al., "The Influence of Dissolved Gases on the Density of Water", Metrologia, vol. 21, pp. 19-26 (1985).

(Continued)

*Primary Examiner* — Robert A Hopkins
(74) *Attorney, Agent, or Firm* — Carrier Blackman & Associates, P.C.; Joseph P. Carrier; William D. Blackman

(57) ABSTRACT

A system for generating liquid which is stably infused with gas, including a pressurized gas source, a pressurized liquid source, an enclosed vessel into which the pressurized gas and pressurized liquid are injected such that the gas becomes infused into the liquid so as to generate a gas-infused liquid and a fluid path into which the gas-infused fluid flows after being discharged from the vessel, wherein the fluid path includes multiple radially bent sections and multiple substantially straight section fixed in a three dimensional (3D) arrangement such that the when the gas-infused carrier fluid flows through the fluid path it is pressed inwardly of the 3D arrangement from multiple different directions to effect a multi-dense, orbital or spherical compaction of elements of the gas-infused liquid thereby forming the infused gas into nanobubbles in the gas-infused liquid.

11 Claims, 8 Drawing Sheets

(56) References Cited

U.S. PATENT DOCUMENTS

| | | | | |
|---|---|---|---|---|
| 7,294,278 | B2 | 11/2007 | Spears et al. | |
| 7,537,200 | B2 | 5/2009 | Glassford | |
| 8,276,888 | B2 | 10/2012 | Osborn et al. | |
| 8,500,104 | B2 | 8/2013 | Spears et al. | |
| 2006/0036047 | A1 | 2/2006 | Klostermann et al. | |
| 2009/0234225 | A1 | 9/2009 | Martin et al. | |
| 2010/0276819 | A1* | 11/2010 | Teng ..... | A61H 33/027 261/31 |
| 2011/0127682 | A1 | 6/2011 | Burns et al. | |
| 2012/0228404 | A1 | 9/2012 | Richardson | |
| 2013/0092626 | A1 | 4/2013 | Zimmerman et al. | |
| 2013/0118977 | A1 | 5/2013 | Eppink et al. | |
| 2013/0233782 | A1 | 9/2013 | Eppink et al. | |
| 2014/0048494 | A1 | 2/2014 | Simmons, Jr. | |

OTHER PUBLICATIONS

PCT/ISA/210 of PCT/US2014/64727, date of completion Feb. 13, 2015.

* cited by examiner

| psi | DO |
|---|---|
| 0 | 0 |
| 50 | 12 |
| 150 | 135 |
| 300 | 640 |

| psi | density | density 25 C |
|---|---|---|
| 0 | 1 | 1 |
| 50 | 0.937 | |
| 150 | 0.927 | |
| 300 | 0.653 | |

D-D
Typical section

SYSTEM AND METHOD FOR STABLY INFUSING GAS INTO LIQUID, AND METHODS OF USING THE GAS INFUSED LIQUID

BACKGROUND OF THE INVENTION

1. Field of the Invention

The present disclosure relates to a method and apparatus for stably infusing gas into liquid in the form of nanobubbles, and methods for using the gas infused liquid. More particularly, the present disclosure relates to such a system and method which can efficiently and stably infuse gas into liquid at higher levels and longer duration than has been previously possible, and methods of using the gas infused liquid.

BACKGROUND

Systems and methods are known that make use of liquids infused with a gas. For example, the present inventor has previously disclosed such a system and method in International Application PCT/US2014/064727, filed 10 Nov. 2014, which claims priority from U.S. Provisional Application 61/904,755. The disclosures of International Application PCT/US2014/064727 and U.S. Provisional Application 61/904,755 are incorporated herein by reference.

The present inventor's previous disclosures identify some other previously known systems and methods involving liquids infused with gas, and present some improvements thereto. The previously disclosed improvements involve a pressurization vessel into which a liquid (typically water or an aqueous based solution) and a gas are sprayed or otherwise introduced under pressure such that the liquid becomes highly infused with the gas, after which the pressurized, gas-infused liquid is passed through a special flow path including numerous alternating flow regions of laminar flow and turbulent flow, e.g., the special flow path may be in the form of a tubular flow path including an alternating series of radially bent sections and straight sections which are joined together in a series of bows which are substantially "8" shaped. The previous improvements including the special flow path function to form the infused gas into nanobubbles which stably remain in the liquid for an extended time period, e.g., weeks, and some methods of using the nanobubble-containing liquid for various purposes. If the gas-infused water is not passed through the special flow path, the infused gas forms into larger or coarse bubbles which are not stable, grow larger in size, and are released from the liquid in a relatively short time period.

As previously disclosed, there are many purposes to which nanobubble-containing liquids may be usefully applied, including admixing or injecting the nanobubble-containing liquid into: water containing oil and/or oil-water emulsions to promote separation of the hydrocarbons from the water; water containing dissolved salts and/or shale (fracking water) to promote precipitation of the salts and shale from the fracking water; water containing suspended solids to promote separation of the suspended solids from the water; and various aqueous based solutions to change the pH thereof to facilitate separation of materials from the solutions by coagulation, polymerization, salt formation, crystallization, and/or effervescence.

Nanobubbles are normally only associated with water or aqueous based solutions. See, for example, M. Chapman Water Structure and Science website, Nanobubbles (Ultrafine Bubbles), 2007, which is incorporated herein by reference. Generally, bubbles having a size of 0.5-200 nm are considered nanobubbles. Nanobubbles tend to stably remain in water or aqueous solution much longer than larger bubbles, and the smaller the nanobubble the greater the concentration they can be infused into the water or aqueous solution. Throughout this disclosure references to "water" in which gas is to be infused and/or nanobubbles are to be formed encompasses not only water per se, but any aqueous solution containing water. Additionally, the systems and methods according to the present invention are not limited to infusing gas into and/or forming nanobubbles in water or aqueous solutions, and may be applied for stably infusing various gasses into non-aqueous liquids. Also, the aqueous and non-aqueous liquids into which gasses may be infused according to the present invention include liquids with various viscosities, including low viscosity liquids such as water and high viscosity liquids such as creams.

Although the present inventor's previously disclosed improvements as discussed above provide significant advantages over the other previously known systems and methods, desiderata still exist in the art for further increasing the amount/volume of various gasses that may be stably infused into liquids as nanobubbles or otherwise, for increasing the stability or length of time that the nanobubbles or gasses will remain in the liquids, for efficiently producing and utilizing the nanobubble- or gas-containing liquids, and for new specific applications for using the gas-infused liquids.

SUMMARY OF THE INVENTION

The present invention has been created with the object of satisfying the discussed desiderata.

According to a first aspect of the present invention there is provided a system for generating liquid which is stably infused with gas, comprising: a pressurized gas source; a pressurized liquid source; an enclosed vessel into which the pressurized gas and pressurized liquid are introduced such that the gas becomes infused into the liquid so as to generate a gas-infused liquid; and a fluid path into which the gas-infused liquid flows after being discharged from the vessel, wherein the fluid path includes multiple radial bends fixed in a three dimensional (3D) arrangement such that the when the gas-infused carrier fluid flows through the fluid path it is pressed inwardly of the 3D arrangement from multiple different directions to effect a multi-dense, orbital or spherical compaction of elements of the gas-infused carrier fluid, thereby forming the infused gas into nanobubbles in the liquid.

In such system according to the first aspect: the liquid may be water, an aqueous solution, or some other liquid; the radial bends may substantially orbitally or spherically surround a central portion of the 3D arrangement; the tubular fluid path may also include multiple sections which are substantially straight and are disposed alternately with the multiple radial bends in forming the 3D arrangement; the radial bends may cause the gas-infused aqueous carrier fluid to flow turbulently therein and the substantially straight sections may cause the gas-infused aqueous carrier fluid to flow laminarly therein; each of the radial bends of the tubular fluid path may cause a total change of direction of flow of the gas-infused aqueous carrier fluid in a range of 60°-270°; the tubular fluid path including multiple radial bends may create multi-dense bonding of elements of the gas-infused aqueous carrier fluid through at least one of covalent, network covalent, ionic, polar, non-polar, and metallic bonding; and the pressure inside the pressurized vessel and in the tubular fluid path may be in a range of 50-300 PSI.

With such system according to the first aspect of the invention, the tubular fluid path more effectively and completely generates multi-dense compaction of elements in the gas-infused aqueous carrier fluid, and without creating cavitation of nanobubble nuclei, than has been previously possible even with the present inventor's previously disclosed improvements. This leads to generation of smaller and more stable nanobubbles in the gas-infused carrier fluid, and most significantly—can cause the gas to become completely or substantially completely dissolved in the liquid, even at high gas concentration levels. To the inventor's knowledge such complete or substantially complete dissolution of the gas into the liquid has not been previously accomplished, even with the inventor's previously disclosed systems and methods.

Such system according to the first aspect creates smaller nanobubbles and a greater overall content of infused gas in the carrier fluid than can be achieved with the present inventor's previously disclosed systems and methods, again, including nanobubbles that are completely or substantially completely dissolved in the liquids. Further, the smaller size nanobubbles more stably remain in the carrier fluid than the nanobubbles generated with the inventor's previously disclosed systems and methods, especially when the nanobubbles are completely or substantially completely dissolved in the liquid. For example, a half life of the nanobubbles generated with the previously disclosed systems and methods may be approximately 15 days at standard temperature and pressure when the gas-infused aqueous carrier fluid is left undisturbed, whereas a half life of the nanobubbles in the aqueous carrier fluid generated with the system according to the first aspect of the present invention is at least approximately 30 days at standard temperature and pressure when the gas-infused is left undisturbed.

Also in such system according to the first aspect, an outlet end of the fluid path where the stabilized, gas-infused liquid is discharged from the flow path may have a reduced wall thickness, and may be either squared or tapered such that it is widest at a free end surface thereof and becomes progressively less wide toward the remainder of the flow path. Such reduced wall thickness, and squared or tapered outlet end is desirable for preventing or minimizing cavitation of the injected liquid as it exits the flow path. Cavitation would undesirably cause some of the infused gas to come out of the liquid and be released into the ambient environment, and hence reduce the efficiency of the system.

According to a second aspect of the present invention, there is provided a system for generating liquid which is infused with gas under hyperbaric conditions, comprising: a pressurized gas source; a liquid source; a pump which pressurizes the liquid; a motor which drives the pump; an enclosed vessel into which the pressurized gas and pressurized liquid may be injected such that the gas becomes infused into the liquid under hyperbaric conditions to generate a gas-infused liquid, the vessel having a discharge port for the gas-infused liquid in a lower portion thereof; a first pressure sensor for detecting a pressure above the fluid level in the vessel; a second pressure sensor for detecting a pressure at the lower portion of the vessel; and a controller which receives outputs from the sensors and controls the motor to drive the pump based on the sensor outputs, and based on a preset rate of gas-infused liquid to be discharged and a preset amount of gas to be contained in the discharged gas-infused liquid.

With such system according to the second aspect of the invention, the gas-infused liquid is very efficiently generated not only based on the desired amount of gas infusion, but also based on the rate of gas-infused liquid being discharged from the vessel, and the actual conditions within the enclosed vessel, which vary greatly based the amount of gas infusion, the type of gas(es) being infused, and the type of liquid into which the gas(es) is being infused. Generally, it is desirable to maintain the fluid level within the vessel at approximately the midpoint thereof, but this can change, again, depending on several factors, including the amount and type(s) of gas(es) being infused, the type and viscosity of liquid into which the gas(es) is/are being infused, the desired amount of gas-infusion, the desires output rate of gas-infused liquid, etc. For example, if 500 ppm of gas is infused into the fluid, the gas-infused fluid will have a lower specific gravity than that of the same fluid which has 250 ppm of gas infused therein. This, in turn, will affect the optimal fluid level to be maintained in the vessel, and correspondingly require the pump to be driven at a different degree to achieve the optimal fluid level. As another example, if the desired rate of gas-infused liquid to be output is relatively large, it may be desirable to have a lower level of liquid in the vessel, which would give the gas a longer time to infuse into the liquid, which is typically at the top of the vessel.

According to a third aspect of the present invention, in addition to the second aspect, the pump is a variable pressure pump and the system further comprises an injection nozzle through which the pressurized liquid is injected into the vessel, the injection nozzle including: a housing having a valve seat disposed therein; a valve member which is movable relative to the valve seat within the housing; and a biasing member which urges the valve member toward the valve seat, wherein the valve member moves increasingly away from the valve seat as the pressure of the pressurized liquid increases such that flow rate of the pressurized liquid into the vessel also increases as the pressure of the pressurized liquid increases, and wherein a surface of at least one of the valve member and the valve seat has protrusions provided thereon where the valve member and the valve seat contact each other to define minor flow passages for the pressurized liquid.

Such system according to the third aspect of the invention provides multiple advantages. To any extent that the pressurized liquid may contain some amount of solid matter therein, the injection nozzle may tend to get clogged with the solid matter. If this happens, the pressure of the liquid will likely increase because the pump is generally controlled based on an amount of liquid to be injected into the vessel so as to maintain a desired liquid level in the vessel. In turn, the increased liquid pressure may dislodge some or all of the solid matter clogging the nozzle, will move the valve member increasingly further away from the valve seat as the pressure increases, and at some point the pressurized liquid will flush the solid matter out of the nozzle and into the vessel, such that the injection nozzle is essentially self-cleaning. Further, the minor flow passages help to break up the injected liquid into fine droplets, and will normally permit a small amount of pressurized liquid to be discharged through the injection nozzle even when the valve member is fully engaged against the valve seat. This is desirable for preventing water hammer. Also, to any extent that the liquid contains solid matter and the solid matter clogs the minor flow passages, again, the self-cleaning nature of the liquid injection nozzle 20 will also clean the solid matter from the minor flow passages 31.

For a more complete understanding of the present invention, the reader is referred to the following detailed description section, which should be read in conjunction with the accompanying drawings showing present embodiments of the invention. Throughout the following detailed description and in the drawings, like numbers refer to like parts.

Intent of Disclosure

Although the following disclosure offered for public dissemination is detailed to ensure adequacy and aid in understanding of the invention, this is not intended to prejudice that purpose of a patent which is to cover each new inventive concept therein no matter how it may later be disguised by variations in form or additions of further improvements. The claims at the end hereof are the chief aid toward this purpose, as it is these that meet the requirement of pointing out the improvements, combinations and methods in which the inventive concepts are found.

There have been chosen specific exemplary embodiments of a system for generating a gas-infused liquid and a flow path arrangement for stabilizing the gas-infused liquid according to the present invention and specific alternative structures and modifications thereto. The exemplary embodiments chosen for the purposes of illustration and description of the structure and method of the invention are shown in the accompanying drawings forming a part of the specification.

DETAILED DESCRIPTION OF PRESENT EXEMPLARY EMBODIMENTS

System for Infusing Gas into Liquid

Figure 1:
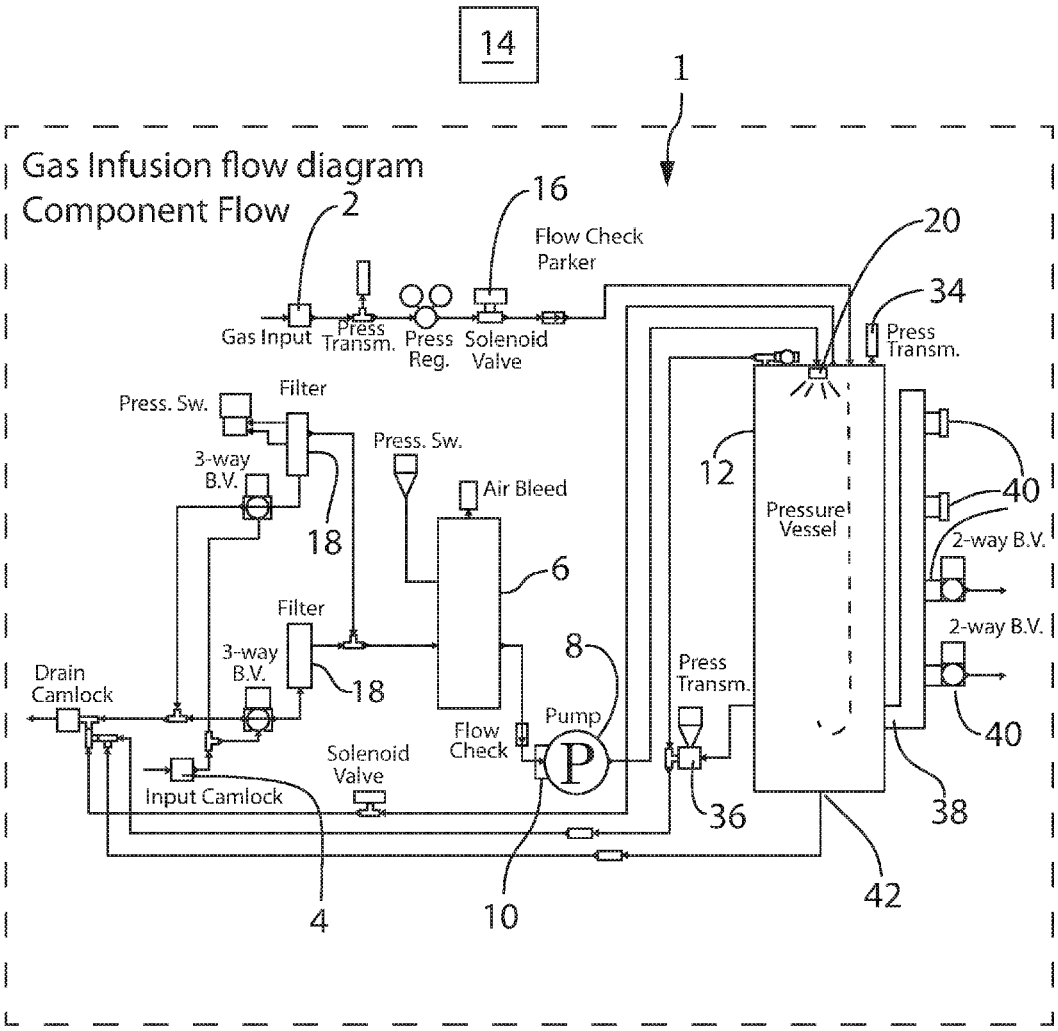
FIG. 1 is a schematic diagram of a system for generating a gas-infused liquid under hyperbaric conditions according to an exemplary embodiment of the present invention.

With reference to FIG. 1 there is shown a schematic diagram of a system 1 for generating a gas-infused liquid under hyperbaric conditions according to an exemplary embodiment of the present invention. The system 1 generally includes a pressurized gas source 2, a source of water, an aqueous liquid, or other liquid 4, a degassifier 6, a pump 8 for the liquid, a motor 10 which drives the pump, an enclosed pressure vessel 12 into which the pressurized gas and the liquid are injected for thereby generating a gas-infused fluid, and a controller 14 which controls operation of the system. Gas-infused liquid discharged from the system 1 of FIG. 1 may be directed to flow through a special flow path arrangement, an exemplary embodiment of which is shown at 100 in FIGS. 6A-6C, to thereby stabilize the infused gas in the liquid, e.g., in the form of nanobubbles, as discussed further below.

The pressurized gas source 2 may comprise any appropriate gas or gasses which are to be infused in the liquid and would be regulated at an appropriate pressure for the desired amount of infusion into the liquid, e.g., 50 to 300 psi. A valve 16 such a solenoid valve may be provided in a gas flow line for controlling flow of the gas or gasses into the pressure vessel 12, which valve is controlled by the controller 14. The gas or gasses may be injected into any appropriate portion of the pressure vessel, such as a top portion above a fluid level in the vessel, a bottom portion below the fluid level in the vessel, or into multiple portions of the vessel.

The liquid source 4 may comprise water, an aqueous solution, or any appropriate liquid which is to be infused with the gas or gasses, e.g., it may be may be a pure liquid or a liquid containing various impurities therein. The liquid may be a liquid which is to be directly treated by reacting with the gas or gasses infused therein or is to be otherwise treated in a process promoted by the gas or gasses infused therein, such as bio remediation of waste water. The liquid may be one that will be subsequently reacted with another substance in a process promoted by the gas or gasses infused therein, such as an aqueous solution which is to subsequently contacted or combined with a liquid hydrocarbon for removing solid matter and/or other undesirable substances from the hydrocarbon. In an exemplary embodiment, the liquid to be gas-infused in the pressure vessel 12 and the flow path arrangement is water and the gas to be infused therein contains oxygen. The water can be distilled water, well water, recovered water, waste water, brine, salt water, or a mixture thereof. The oxygen-containing gas may be air, substantially pure oxygen, or something else. For many applications, e.g., applications involving organic and/or biological materials, the gas may include at least 80%, or at least 90% oxygen. The system 1 may further includes an oxygen concentrator (e.g., a vacuum swing adsorption unit, not shown) and the gas carried in the pressure vessel is the product of the oxygen concentrator.

To any extent that the liquid may contain impurities such as solid matter therein, the system 1 may further include one or more filters such as shown at 18 for removing the impurities. It is normally desirable that the liquid should contain no gas as it is pumped and injected into the pressure vessel 12, e.g., it is in a hydraulic state, so that it may be more reliably controlled. Correspondingly, the liquid may be passed through the degassifier 6 prior to being pumped.

The pump 8 may be any appropriate pump for a given application, including the type and viscosity of liquid, whether the liquid contains suspended solids or other solid matter, rate of liquid to be pumped, pressure(s) at which the liquid is to be pumped, etc. For many applications a variable pressure, triplex, positive displacement pump would be suitable. The motor 10 which drives the pump 8 is controlled by the controller 14 according to an appropriate algorithm and/or program stored in a memory of the controller, as discussed further below.

After the liquid passes through the pump 8 it is then injected into the pressure vessel 12. This may involve one or more injection nozzles 20, which may be disposed at the top of the pressure vessel 12 to inject the liquid as an atomized spray downwardly into the vessel. After the droplets of the liquid are injected into the top of the vessel, the droplets move downwardly and becomes infused with the gas. For this purpose, the liquid injection nozzle(s) 20 may be configured to generate a large cone angle spray pattern of fine droplets of the liquid as it is injected into the vessel 12. Typically, the gas-infused liquid will fill the vessel about half way during a gas-infusion operation in which the gas(es) and liquid are injected into the vessel while the gas-infused liquid is discharged from the vessel at a lower portion thereof. The upper portion of the vessel is filled with the pressurized gas that has been injected therein and the liquid droplets falling through the gas.

Figure 4A:
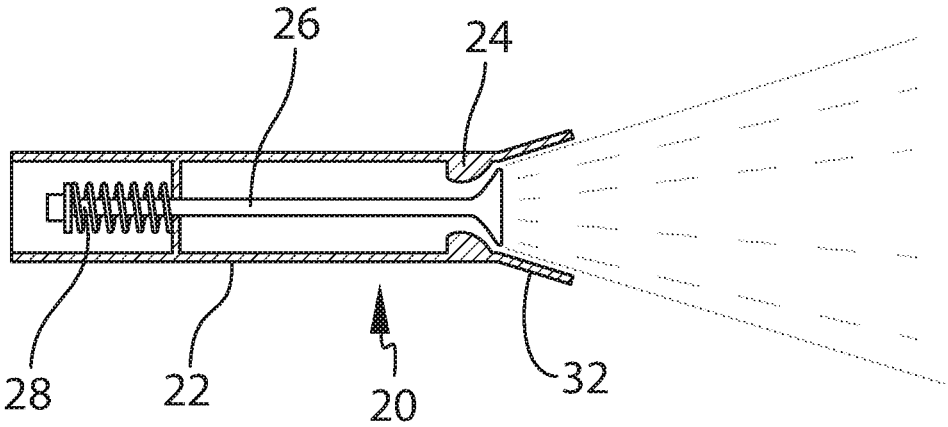
FIG. 4A is a cross sectional view of an exemplary embodiment of a liquid injection nozzle which may be used in the system of FIG. 1.

With reference to FIG. 4A there is shown a cross sectional view of an exemplary embodiment of a liquid injection nozzle 20 which may be used according to the present invention. The injection nozzle 20 includes a housing 22 having a valve seat 24 disposed therein, a valve member 26 which is movable relative to the valve seat within the housing, and a biasing member 28 such as a coil spring which urges the valve member toward the valve seat. With such nozzle 20, the biasing member 28 will maintain the valve member in contact with the valve seat when no liquid is being pumped into the vessel, but when the liquid is being pumped the pressure thereof overcomes the force of the biasing member and moves increasingly away from the valve seat as the pressure of the pressurized liquid is increased. Correspondingly, the amount of liquid being injected also increases with increasing fluid pressure. To any extent that the pressurized liquid may contain some amount of solid matter therein, the injection nozzle may tend to get clogged with the solid matter. If this happens, the pressure of the liquid will likely increase because the pump is generally variably controlled based on an amount gas-infused liquid which is being discharged from the vessel 12, e.g., the pump is controlled to replace the amount of liquid being discharged as gas-infused liquid from the vessel. In turn, the increased liquid pressure may dislodge some or all of the solid matter clogging the nozzle, and will move the valve member further away from the valve seat somewhat, and at some point the pressurized fluid will move the valve member sufficiently away from the valve seat to permit fluid flow that will flush the solid matter out of the nozzle and into the vessel 12, such that the injection nozzle is essentially self-cleaning.

As also shown in FIG. 4A, an end portion 32 of the liquid injection nozzle 20 where the liquid is injected into the pressure vessel 12 may be tapered such that it is widest at the free end surface thereof and becomes progressively less wide as it gets closer to the valve seat 24. Such tapering is desirable for creating a large cone angle of fine droplets of the injected liquid as it leaves the nozzle, which large cone angle may be almost as wide as the inner circumference of the vessel for increasing the rate and efficiency of gas infusion into the liquid.

Figure 4B:
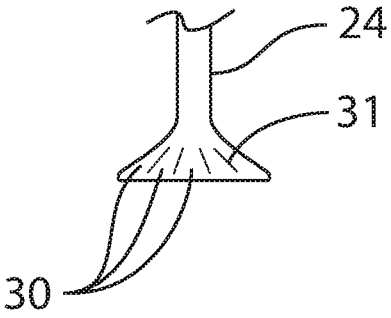
FIG. 4B is an enlarged view of a valve element of the nozzle of FIG. 4A.

With reference to FIG. 4B, a surface of at least one of the valve member 26 and the valve seat 24 may have protrusions 30 provided thereon where the valve member and the valve seat contact each other, to thereby define minor flow passages 31 for the pressurized liquid between the protrusions. In the depicted embodiment, the protrusions 30 are provided on the valve member 26, but could alternatively or additionally be provided on a surface of the valve seat 24. Such protrusions 30 may be provided in any appropriate manner such as being molded into the surface when the valve member and/or valve seat is formed, by machining or etching the minor flow passages 31 into the surface, etc. The minor flow passages 31 help to break up the injected liquid into fine droplets and will normally permit a small amount of pressurized liquid to pass through the injection nozzle even when the valve member is fully engaged against the valve seat. This is desirable for preventing water hammer. Also, to any extent that the liquid contains solid matter and the solid matter clogs the minor flow passages, again, the self-cleaning nature of the liquid injection nozzle 20 will also clean the solid matter from the minor flow passages 31.

While the liquid injection nozzle is disposed separately from where the gas is introduced into the vessel 12 in the exemplary embodiment, it is possible to combine the gas introduction together with the liquid injection nozzle 20.

The pressure vessel 12 is enclosed, may be any appropriate size, and suitable for maintaining desired hyperbaric conditions therein, e.g. pressures up to 500 psi and more. The vessel has one or more discharge ports 38 through which the gas-infused liquid may be discharged. In the depicted embodiment only one discharge port 38 is shown, but this port may have multiple outlets 40 for withdrawing the gas-infused liquid. For sensing pressure and fluid level within the vessel, a first pressure sensor 34 may be disposed at an upper portion of the vessel for detecting a pressure within the vessel above a level of the gas-infused liquid which, again, may typically fill the vessel about half way, and a second pressure sensor 36 may be disposed at a lower portion of the vessel at the same or approximately the same level as the discharge port 38 where the gas-infused liquid is to be discharged from the vessel. Given that the liquid may contain solid matter and/or that substances may precipitate out of the gas-infused liquid, the vessel 12 may also include a drain 42 at bottom thereof through which any such solid matter, precipitates, or other heavier/denser substances may be conveniently withdrawn. The drain 42 may be disposed below the level of the discharge port 38 as shown.

Figure 2:
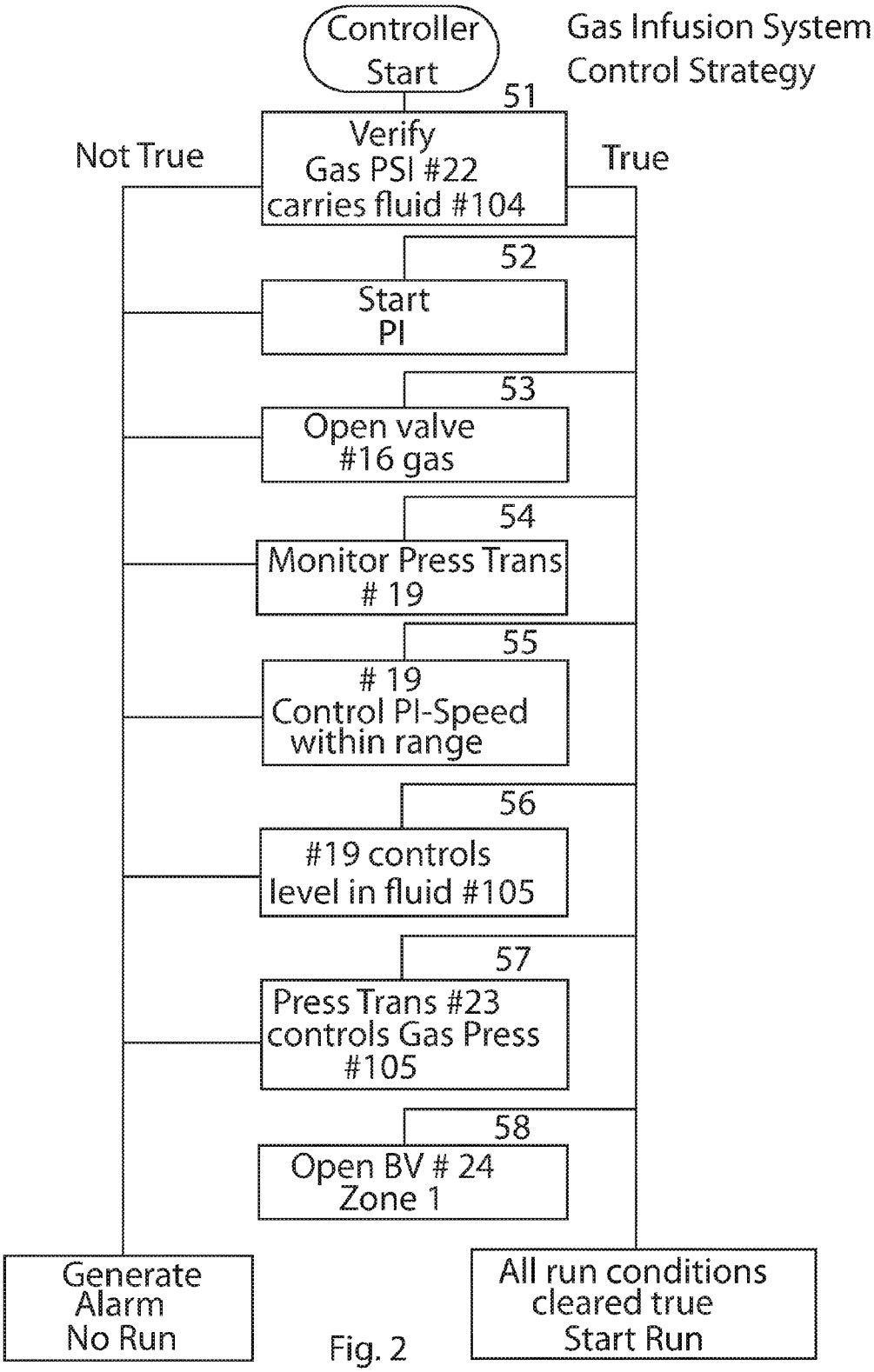
FIG. 2 is a flow chart of the operation of the system of FIG. 1.
Figure 3:
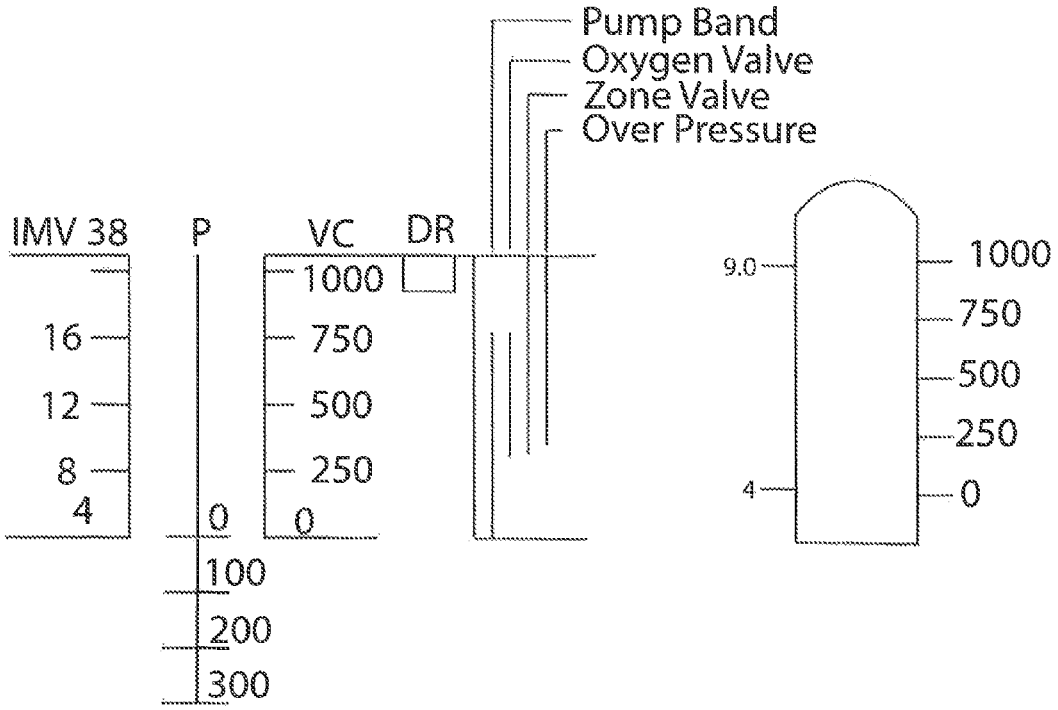
FIG. 3 is an exemplary control strategy for operation of a liquid pump of the system of FIG. 1.

The controller 14 may be an electronic control unit (ECO), microprocessor, or the like which reads and executes programs stored in a computer readable media to control the various aspects of the gas-infusion operation according to the present invention, e.g., the motor 10 which drives the pump 8, the valve 16 which controls the pressure—amount of gas being injected into the vessel 12, discharge valves 40 which control the amount of gas-infused liquid being discharged from the vessel, etc. FIG. 2 shows a flow chart of an exemplary gas-infusion operation carried out using the system of FIG. 1, and FIG. 3 shows a control algorithm for driving the pump 8 via motor 10 in the system according to an exemplary control strategy in steps S5-S6 of the exemplary gas-infusion operation.

Referring to FIG. 2, when the operation is to begin the controller 14 initially seeks to confirm that the gas source 2 is at an appropriate pressure level in step S1, and if so sends a drive signal to motor 10 to start operation of the pump 8 to begin liquid injection through nozzle 20 in step S2 and then opens valve 16 to begin gas injection into the vessel 12 at step S3 so that the vessel begins to fill with gas-infused liquid. At step S4 pressure at the lower portion of the vessel is monitored via sensor 36, and at step S5 operation of the pump 8 is generally controlled according to initial, preset conditions, including the pressures of the liquid and gas being injected into vessel, and the desired amount of gas infusion in the liquid to be discharged through the port 38. Then at step S6 specific control of the pump via motor 10 is initiated based on actual fluid level in the vessel, which may be determined based on the outputs of the pressure sensors 34, 36. Pressure of the gas(es) being injected may also adjusted based on the detected fluid level at step S7, and at step S8 one or more of the discharge valves 40 associated with discharge port 38 is opened for discharging the gas-infused liquid from the vessel. After this, the system may then run continuously for any given length of time for creating and discharging a desired amount of the gas-infused liquid containing a desired amount of infused gas, while appropriate amounts of the gas and liquid are injected into the vessel for replacing the gas-infused liquid being discharged.

Through much investigation, the present inventor has discovered that while there are numerous and diverse factors that have an impact on how gasses are infused into liquids within the vessel 12, it is extremely difficult to account for all of these factors for many applications. Some factors include: the type(s) of liquid(s); types of solids and/or other matter(s) contained in the liquid(s), if any; the type and pressure of gas(es); the rate at which gas-infused liquid is being discharged from the vessel; the viscosity of the liquid(s); the amount of gas(es) that are to be infused in the liquid(s); etc. For example, some element(s) in the liquid(s) may inhibit infusion of specific gas(es) into the liquid(s), e.g., sodium contained in an aqueous solution will reduce the amount of oxygen that may be infused into the aqueous solution because oxygen does not want to bond with sodium. Other elements or chemicals in a liquid may also react positively or negatively with the gas(es) to be infused, such that it becomes very complex in relation to how the atoms and molecules tie/bond together, e.g., through at least one of covalent, network covalent, ionic, polar, non-polar, and metallic bonding and the special limitations involved with same.

As another example, while it is generally desirable to maintain the fluid level within the vessel at approximately the midpoint thereof, this can change, again, depending on several factors, including the amount and type(s) of gas(es) being infused, the type and viscosity of liquid into which the gas(es) is/are being infused, the desired amount of gas-infusion, the desired output or discharge rate of gas-infused liquid, etc. For example, if 500 ppm of gas is infused into the fluid, the gas-infused fluid will have a lower specific gravity than that of the same fluid which has 250 ppm of gas infused therein. This, in turn, will affect the optimal fluid level to be maintained in the vessel, and correspondingly require the pump to be driven at a different degree to achieve the optimal fluid level. As another example, if the desired rate of gas-infused liquid to be output is relatively large, it may be desirable to have a lower level of liquid in the vessel, which would give the gas a longer time to infuse into the liquid, which is typically at the top of the vessel.

As still another example, the rate at which gas-infused liquid is being discharged from the vessel may affect the optimum liquid level within the vessel, e.g., if the gas-infused liquid is being discharged at a relatively high rate and with a relatively high gas-infusion level, the optimum liquid level may be below the mid point of the vessel in order to give the injected liquid droplets a longer time to become infused with gas as they fall through the gas-filled upper portion of the vessel.

Based on the investigations, the present inventor has discovered that while many different factors could be accounted for in a complex manner when controlling the injection of liquid(s) into the vessel 12, a sufficiently optimal control can be relatively easily achieved according to liquid level within the vessel and which is based on desired discharge rate of any given gas-infused liquid and desired gas-infusion level in the discharged liquid. Particularly, the inventor has discovered that there is an optimum range or band of liquid level within the vessel for any given application (desired output rate of a given liquid with a given level of infusion of a given gas), as long as the actual liquid level in the vessel is maintained within the optimum range, this will result in achieving or substantially achieving the desired output rate of the liquid having the desired gas-infusion level. Thus, given that the optimum liquid level depends in large part on the amount of output of the gas-infused liquid, and the pump 8 may be controlled to simply replace the amount of liquid that is being discharged from the vessel, e.g., the pump may be driven by the motor 10 to achieve a liquid pressure that matches the pressure (resistance) within the vessel 12. Of course, there may be other lesser factors to consider, including solids that may separate or precipitate from the liquid in the vessel. In practice, the optimum ranges or bands of liquid level within the vessel for a variety of liquids, gasses, discharge rates, and gas-infusion amounts may be experimentally determined in advance and stored in look-up table(s) in a memory of the controller 14, or the controller may store predetermined algorithm(s) into which values for the different variables are input for a given application, so that the controller will determine an optimum range or band of liquid level within the vessel for the given application.

Figure 5A:
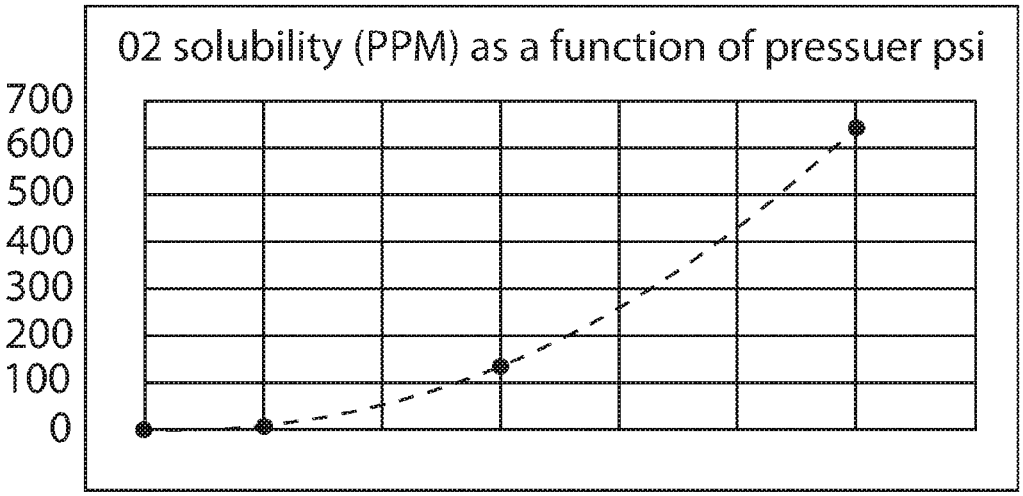
FIG. 5A is a chart showing solubility of oxygen ($O_2$) in water (PPM) as a function of pressure (psi)
Figure 5B:
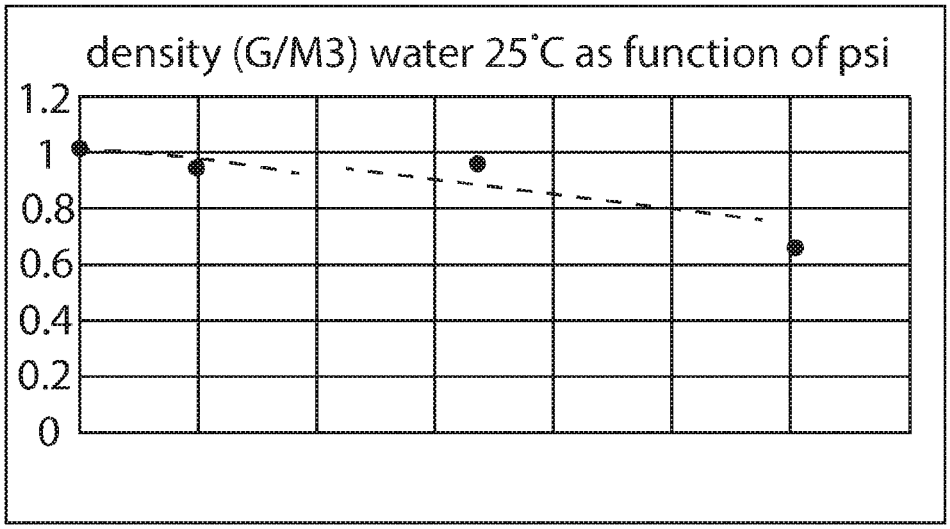
FIG. 5B is a chart showing the density of water ($g/m_3$) as a function of pressure (psi).

Generally, an exemplary algorithm control strategy for controlling the pump 8 is shown in FIG. 3 which, again, seeks to maintain the level of gas-fused liquid in the vessel at at or near an optimum level of the vessel, e.g., midpoint, for a given internal pressure of the vessel to achieve a desired—preset gas-infused liquid output during a gas-infusing operation in which the gas-infused liquid is being continuously discharged out through port 38, while additional liquid and gas are being continuously fed into the vessel. Again, any solids that may separate or precipitate from the liquid in the vessel may be discharged via drain 42, although this is not reflected in FIG. 3. As shown, the control strategy may involve determining a difference (delta) between pressure in the upper portion of the vessel and the pressure at the lower portion of the vessel as measured by sensors 34, 36, which will reflect the level of gas-infused liquid in the bottom portion of the vessel above the discharge port 38 and the pressure head attributable to same. In FIG. 3 the delta corresponds to the value of IMV=Input Millivolts converted to inches (on a scale with 38" as maximum value) Variable Input, P=vessel pressure Variable Input, VC=IMV converted to a valve control scale (VCS), and VCS=Field Device Window of control operation. This is not a straightforward relationship, however, given that the gas infused into the liquid changes (lowers) its specific gravity, and the more gas infused into the liquid the more the specific gravity is changed (lowered). See FIGS. 5A, 5B, as well as an article by H. Watanabe et al., *The Influence of Dissolved Gasses on the Density of Water*, Metrologia 21, 19-26 (1985), which is incorporated herein by reference. For example, if oxygen gas is infused into water at 650 ppm, the resulting oxygen-infused water has a specific gravity which is approximately 34% less than that of pure water. Further, the amount of gas being infused in the liquid is not linearly related to the pressure with in the vessel, e.g., gases are more efficiently infused into liquids at lower pressures than at higher pressures as reflected in FIG. 5A, while the desired amount of gas to be infused into the liquid may be a preset condition in the control strategy. The level of gas-infused liquid in the vessel may be determined in manners other than using the pressure difference (delta), such as using an optical-type or float-type level sensor.

In addition to determining the pressure difference, the controller may also receive inputs pertaining to the pressure in the vessel 12, e.g., using the signal output from the sensor 34, and other inputs including the pressure of gas being injected into the vessel, the amount(s) of gas-infused liquid being discharged from the vessel, feedback relating to the amount of gas actually being infused into the liquid, etc., and based on same will adjust the drive signal to the motor 10 for adjusting the amount and pressure of of the liquid being injected into the vessel, as well as other conditions if necessary, including the pressure of gas being injected into the vessel and the rate(s) of gas-infused liquids being discharged from the vessel. The control operations effected by the controller are, for example, effected every few milli-seconds throughout a gas-infusion operation.

Three Dimensional Flow Path Arrangement

According to an important aspect of the present invention, there is provided a special, three dimensional (3D) flowpath arrangement which stabilizes a gas-infused liquid, such as that discharged from the vessel 12, to a degree that has never previously been achieved. An exemplary embodiment 100 of the special 3D flowpath arrangement is shown in FIGS. 6A-6D. Particularly, the tubular fluid path more effectively and completely generates multi-dense compaction of elements in the gas-infused aqueous carrier fluid, and without creating cavitation of nanobubble nuclei, than has been previously possible even with the present inventor's previously disclosed improvements. This leads to generation of smaller and more stable nanobubbles in the gas-infused carrier fluid, and most significantly—can cause the gas to become completely or substantially completely dissolved in the liquid, even at high gas concentration levels. To the inventor's knowledge such complete or substantially complete dissolution of the gas into the liquid has not been previously accomplished, even with the inventor's previously disclosed systems and methods, and is a very advantageous, unexpected result to persons skilled in the art.

Figure 6A:
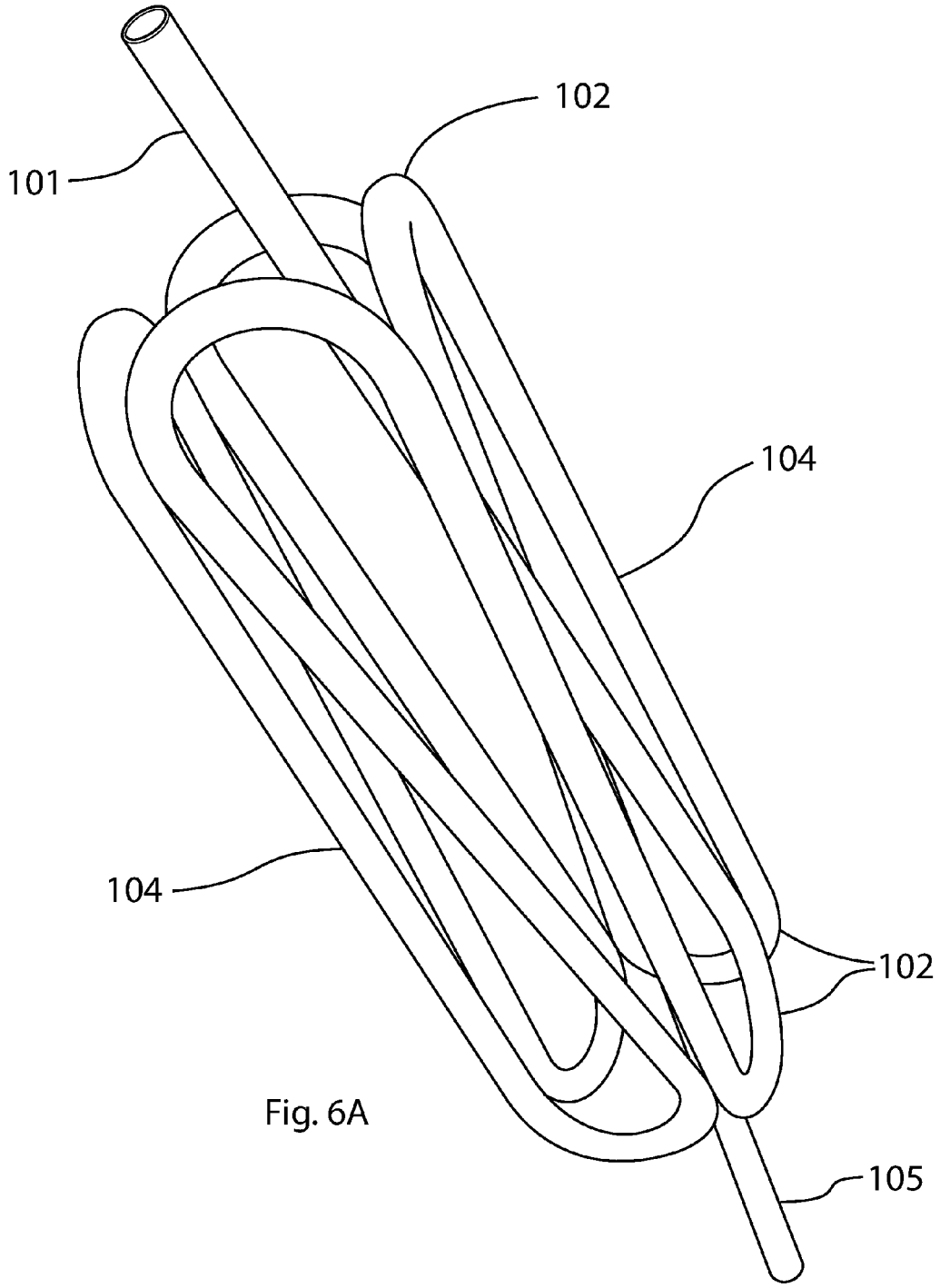
FIG. 6A is a perspective view of an exemplary, three dimensional flow path arrangement according to the present invention which may be used for stabilizing the gas-infused liquid which is output by the system of FIG. 1.
Figure 6B:
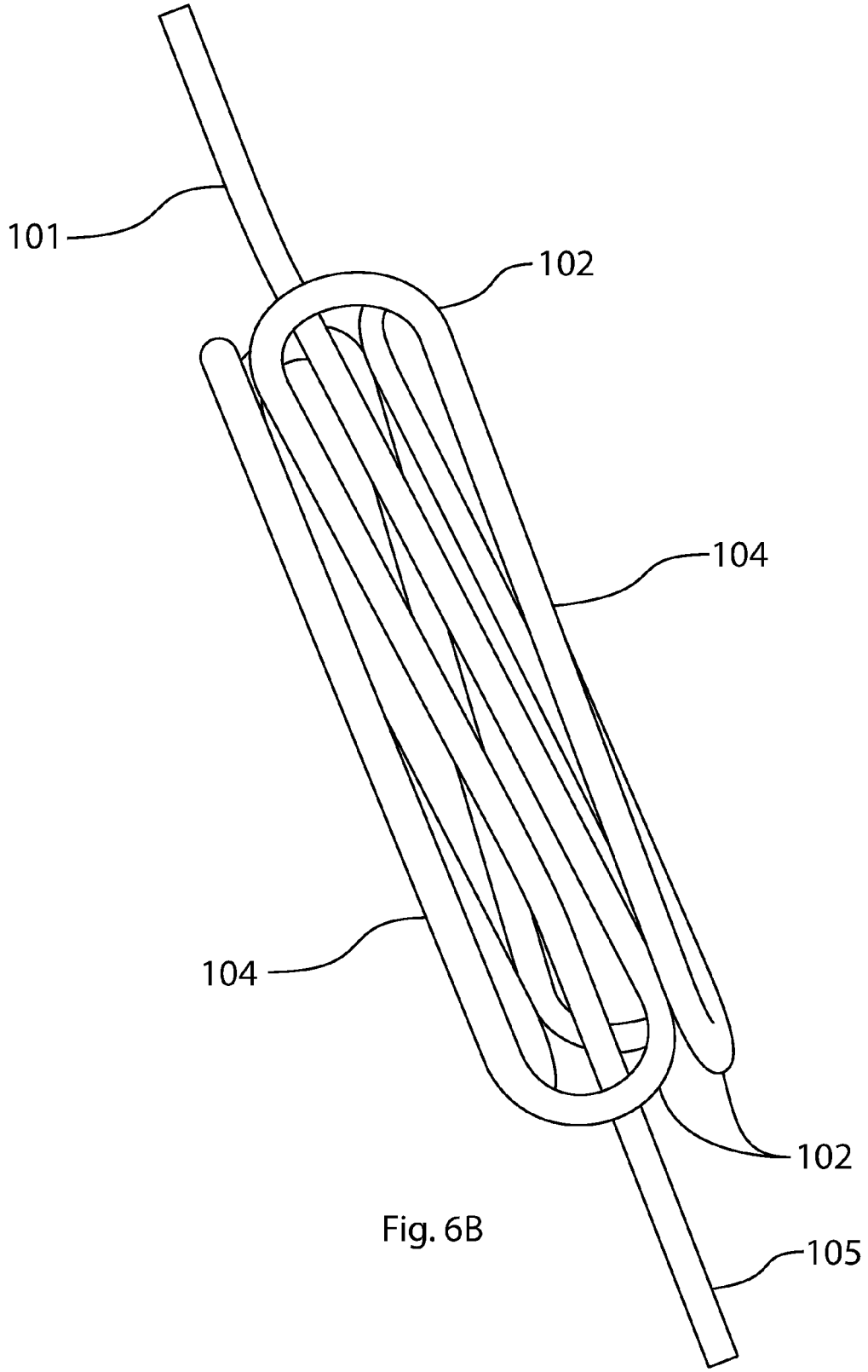
FIG. 6B is a side elevational view of the flow path arrangement of FIG. 6A.
Figure 6C:
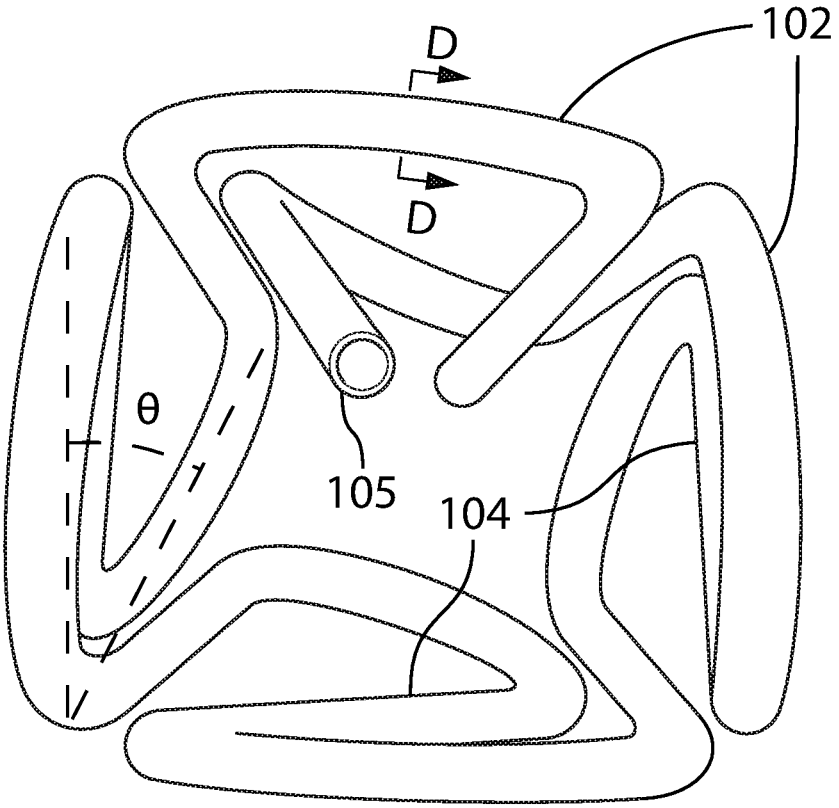
FIG. 6C is an end view of the flow path arrangement of FIG. 6A.
Figure 6D:
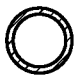
FIG. 6D is cross-sectional view of the tubing in a radially bent section 102 of the arrangement along line D-D in FIG. 6C.

Referring to FIGS. 6A-6D, there is shown an exemplary, three dimensional (3D) flow path arrangement 100 according to the present invention which may be used for stabilizing the gas-infused liquid which is output by the system of FIG. 1 so that all or most of the infused gas stays infused in the liquid for an extended period of time. FIG. 6A is a perspective view of the flow path arrangement, FIG. 6B is a side elevational view of the flow path arrangement of FIG. 6A, FIG. 6C is an end view of the flow path arrangement of FIG. 6A, and FIG. 6D is cross-sectional view of the tubing in a radially bent section 102 of the arrangement along line D-D in FIG. 6C. As depicted, the flow path arrangement 100 may include an inlet section 101 into which the pressurized, gas-infused liquid will be introduced, an alternating series of radially bent sections 102 and substantially straight sections 104 fluidly extending continuously from the inlet section, and an outlet section 105 from which the pressurized gas-infused liquid is discharged from the arrangement. Again, the gas-infused liquid discharged in a pressurized state (e.g., 50-300 psi) from the system 1 of FIG. 1 may be directed to flow through the flow path arrangement 100 to thereby stabilize the infused gas in the liquid, e.g., in the form of nanobubbles, so that all or most of the gas will stably remain in the liquid for an extended period of time, e.g., weeks or months, even more so that the present inventor's previously disclosed improvements as discussed above.

In the exemplary embodiment, the flow path arrangement 100 may be constructed of tubing. The tubing can be of unitary construction, e.g., manufactured from a single continuous piece of tubing, or can be assembled from a plurality of distinct tubing sections which are joined together. If the tubing is formed using a plurality of sections which are joined together, this should be done without creating obstructions which would interrupt flow of the gas-infused liquid through the flowpath, e.g., the joints between sections are free of physical shapes or obstructions. Obstructions may cause cavitation of the liquid, which undesirably tends to cause some of the infused gas to become unstable and released from the liquid, and would lower the efficiency of the flowpath arrangement in stabilizing the gas-infused liquid.

The tubing may be formed of metal such as stainless steel, plastic or other appropriate materials, e.g., materials that will not be detrimentally affected by the pressurized, gas-infused liquid flowing therethrough. Still further, the inner surfaces of the tubing, or portions thereof, may be modified to vary (increase or decrease) a coefficient of friction thereof so as to improve the efficiency and/or effectiveness of the gas-infusion stabilization process. For example, if the tubing is made of metal, internal surfaces of radially bent sections 102 thereof may be acid etched to increase the coefficient of friction thereof and thereby increase the amount of turbulence created in the liquid flowing therethrough, while internal surfaces of straight sections 104 thereof may be lined with a substance such as polytetrafluoroethylene (PTFE) to reduce the coefficient of friction thereof. Modification of the coefficient of friction may be generally desirable to enhance efficiency of the flowpath in stabilizing the infused gas, may be done based on the nature of the gas-infused liquid, e.g., the centipoise or viscosity thereof, etc.

When the gas-infused liquid flows through the substantially straight sections it may flow in a laminar or substantially laminar state, and when it flows through the radially bent sections it may flow in a turbulent or substantially turbulent state. Thus, the radially bent sections 102 may be considered as turbulent flow regions of the arrangement and the substantially straight sections 104 may be considered as laminar flow regions of the arrangement, which turbulent and laminar flow regions can be distinguished by the Reynolds number values thereof. The difference in the Reynolds numbers between the two distinct flow regions can be at least about 500, 1000, 1500, or 2000. Flowing the gas-infused fluid through the laminar and turbulent flow regions of the flow path arrangement has a stabilizing effect on the infused gas, e.g., the gas infused in the fluid is formed into nano-bubbles which will stably remain in the fluid for an extended period of time. If the gas-infused liquid discharged from the vessel 12 is not stabilized, the infused gas will, within a short time period of a day or a few days, form into coarse bubbles, e.g., bubbles having a diameter of 10 μm or more, which are less stable than nanobubbles, grow—expand in size, and are eventually burst so that the gas is released or discharged from the liquid With reference to the FIGS. 6A-6C, a portion of the flow path arrangement 100 extending through adjoining substantially straight sections 104 about a radially bent section 102 may undergo a change of direction in a range of 60° to less than 360°, and preferably to 270° or less. If a total change of direction of flow through a radially bent section adjoining substantially straight sections is in excess of 360°, e.g., the radially bent section is coiled, this is not any more effective in stabilizing the gas in the gas-infused liquid in comparison to when a total change of direction of flow through a radially bent section adjoining substantially straight sections is less than 360°. Moreover, if the total change of direction of flow through a radially bent section adjoining substantially straight sections is in excess of 360°, this will undesirably increase the size of the arrangement without achieving any improved efficiency in stabilization of the infused gas. On the other hand if a total change of direction of flow through a radially bent section adjoining substantially straight sections is less than 60°, this may not create sufficient turbulence in the gas-infused liquid flowing therethrough, which is necessary for breaking up larger quantities of gas into smaller quantities that may be suitably compressed into stable nanobubbles or the like.

Similarly, in the flow path arrangement 100, the radially bent sections 102 and substantially straight sections 104 need not be disposed in a strictly alternating series, e.g., two radially bent sections my be joined directly together or two substantially straight sections 104 may be joined directly together, but a strictly alternating series of the two types of sections is particularly effective and efficient for stabilizing the gas in the liquid. This is due to the fact that the radially bent sections 102 create turbulence in the gas-infused liquid flowing therethrough, which breaks up any larger quantities, e.g., slugs, of infused gas therein into smaller quantities of the gas suitable for compression into nanobubbles or the like, and when the gas-infused liquid flows in a laminar or substantially laminar manner through the substantially straight sections 104 the broken up, smaller quantities of infused gas are therein compressed into stable nanobubbles or the like, so that alternating the two types of section provides the greatest efficiency in stabilizing the infused gas. The substantially straight sections 104, being zones of compression for the infused gas, should create as little friction as possible in the gas-infused liquid flowing therethrough. If two or more of the radially bent sections 102 extend continuously together in the flow path arrangement, e.g., in a coil of more than 360° or even in different directions, the gas is not subjected to compression for an extended period of turbulence, and this merely increases the size of the flowpath arrangement without providing any appreciable benefit. Similarly, if the length of the substantially straight sections 104 is simply increased, again, this will not greatly improve the amount of gas compression achieved therein, and this merely increases the size of the flowpath arrangement without providing any appreciable benefit.

Within the range of 60° to less than 360° for the radially bent sections 102, the greater the radial bend generally corresponds to a greater length of the radially bent section 102, which is desirable for creating more turbulence in the gas-infused liquid flowing therethrough, because this leads to more compression of the smaller, broken up gas quantities in the next substantially straight section 104 following therefrom. Generally, the smaller the degree of bend in the the radially bent sections 102, the greater number of the radially bent sections 102 (and the greater the number of straight or substantially straight sections 104) that will be required to achieve a given output.

As shown in FIGS. 6A-6D the tubing forming the flowpath arrangement 100 will preferably have a substantially constant, circular internal diameter (ID) as the perfect symmetry of the circular cross section is optimal for efficiently stabilizing the infused gas in the liquid because it assures a uniform flowrate of liquid through the entire cross section of the tubing. If the cross section is not circular, e.g, if it is flattened or oval, some portion(s) of the flowpath arrangement will have less resistance to fluid flow than other portion(s) thereof, and the less resistance portions will naturally have a greater flow rate of the liquid therethrough, leading to less efficiency in stabilizing all of the gas-infused liquid.

The ID of the tubing may be of any appropriate size, e.g., from 0.5 mm-160 mm, depending on a desired flow rate of gas-infused liquid therethrough, whether the gas-infused liquid contains solid matter, the type of solid matter, etc. The ID of the tubing will largely dictate the other structural aspects of the flow path arrangement, including overall size. For example, the length of a radially bent section 102 may correspond to the ID of the tubing used in forming same, e.g., if the flowpath arrangement 100 is formed of metal tubing that is bent into shape when forming the radially bent sections 102, the larger the tubing ID the longer the radially bent sections should be to avoid formation of non-uniformities such as flat spots in the tubing.

According to an important aspect of the present invention, the flowpath arrangement 100 may not only include the multiple radially bent sections 102 and the multiple substantially straight sections 104 which are disposed alternately with the multiple radially bent sections in fixed relation as discussed above, but additionally some or all of the substantially straight sections 104 will extend three dimensionally between two of the radially bent sections 102 in the arrangement, rather than two-dimensionally, as shown in FIGS. 6A-6C. In other words, the substantially straight sections 104 extend between the radially bent sections along vectors having components in x, y, and z directions, rather than along vectors having components in only two of the x, y, z directions. Because the substantially straight sections 104 extend three dimensionally between two of the radially bent sections 102 in the arrangement, gas-infused liquid flowing through the flow path is also pressed inwardly of the 3D flowpath 100 from multiple different directions as the fluid passes through the laminar and turbulent flow sections. In the depicted exemplary embodiment of the flowpath arrangement 100 the substantially straight sections 104 may extend between two of the radially bent sections 102 at an angle θ of 20°-60° in the z direction inwardly of the arrangement, as well as a change of direction in the x and y directions in a range of 60° to less than 360° resulting from a transition from one substantially straight section to another about a radially bent section as discussed above. In FIG. 6C the angle θ is approximately 25-30°. Further, the arrangement 100 includes a sufficient number of the different sections 102, 104 that the gas-infused liquid is pressed inwardly from multiple different directions that collectively will press any given portion of the liquid inwardly of the arrangement from all directions that collectively amount to about 360° or more. Hence, such inward pressing may be deemed as orbital or spherical.

As is understood in the art, once a gas bubble is compressed to a certain size within a liquid such as water or an aqueous solution, e.g., several nanometers, the nanobubble is automatically compressed by the surface tension and other factors involved into a spherical shape. Again, see M. Chapman Water Structure and Science website, Nanobubbles (Ultrafine Bubbles), 2007. Using the 3D flowpath arrangement 100 of the present invention, the multidirectional inward pressing of the flowing liquid from all directions that collectively amount to about 360° or more, very efficiently reduces the size of the gas bubbles infused in the liquid to the point that the bubbles become spherical nanobubbles of a very small size, e.g., less than 0.5 nm, which to the present inventor's knowledge has not previously been achieved, at least on a practical, commercial scale. The particular amount of inward pressing may depend on the type of liquid(s) and/or gas(es) involved, e.g., for a liquid with solid matter or other components that may inhibit the gas from being infused therein, it may be desirable to effect the the multi-directional inward pressing of the flowing liquid from all directions that collectively amount to more than 360° in order to assure a sufficient level of compression.

Such multi-directional inward pressing of the gas-infused liquid effects a multi-dense, orbital or spherical compaction of elements of the gas-infused fluid, and without creating cavitation of nanobubble nuclei, as the gas-infused liquid flows through the flow path arrangement 100. The multi-dense bonding of elements of the gas-infused liquid may involve at least one of covalent, network covalent, ionic, polar, non-polar, and metallic bonding. This has not been previously possible with conventional gas-infusion technology known at the time of the present invention, including the present inventor's previously disclosed improvements as disclosed in PCT/US2014/064727, and leads to very efficient generation of smaller and more stable nanobubbles in the gas-infused liquid, as well as a greater overall content of infused gas in the liquid than has been previously possible. The flow path arrangement 100 is significantly more effective at breaking up larger size quantities, e.g., slugs, of gas within the liquid, and turning the larger size gas quantities into smaller size nanobubbles as a gas-infused liquid passes through the flow path arrangement 100 as compared to when the same gas-infused liquid is passed through a flow path arrangement as disclosed in PCT/US2014/064727. Based on the present inventor's investigations, the flowpath arrangement 100 creates nanobubbles which are approximately 25-70% smaller than the nanobubbles created when the same gas-infused liquid is passed through a flow path arrangement according to the present inventor's previously disclosed improvements as disclosed in PCT/US2014/064727. In terms of overall quantity of infused gas, for example, with the technology disclosed in PCT/US2014/064727 the present inventor has achieved oxygen infusion into water up to around 640 mg/l, which generally corresponds to ppm, and which equates to 32% by volume approximately, whereas with the system 1 and flowpath arrangement 100 according to the exemplary embodiments of the present invention, it is anticipated that it will achieve oxygen infusion into water up to around 880 mg/l, which equates to approximately 40% by volume.

Further, the smaller size nanobubbles more stably remain in the carrier fluid than the nanobubbles generated with the inventor's previously disclosed improvements, e.g., a half life of the nanobubbles generated with the previously disclosed improvements may be approximately 15 days at standard temperature and pressure when the gas-infused aqueous carrier fluid is left undisturbed, whereas a half life of the nanobubbles in the aqueous carrier fluid generated with the system according to the first aspect of the present invention may be approximately 30 days or more at standard temperature and pressure when the gas-infused is left undisturbed.

Still further and very significantly, the flowpath arrangement 100 can cause the gas to become completely or substantially completely dissolved in the liquid, even at high gas concentration levels. To the inventor's knowledge such complete or substantially complete dissolution of the gas into the liquid has not been previously accomplished, even with the inventor's previously disclosed systems and methods, and is a very advantageous, unexpected result to persons skilled in the art. The present inventor has generally confirmed the complete dissolution of the oxygen into water spectroscopically. Particularly, the present inventor has conducted three distinct spectroscopic tests, which all confirm that the infused gas is completely dissolved. According to a first test, when shining a laser beam through oxygen-infused water stabilized by being passed through the flowpath arrangement 100, no scattering of the laser beam was observed. A second test was performed with a Olympus variable light wave electron microscope, whereas the aqueous solution was stained with #4 red magenta die (this highlights the gas as gas can not be stained). In viewing the stained solution with a yellow filter plate and a white light wave length of 331 Nm the gas formation (bubble)) size was measured using a stage reticule. A third test was performed with the Olympus microscope TopView™ imaging and measurement computer software. The three methods all produced a reference number within a couple nanometers of each other, and all of which showed no appreciable level of light scattering consistent with the gas being completely dissolved in the liquid. Conversely, all three methods detected an appreciable level of light scattering in the same gas-infused liquid that was stabilized by flowing through the flowpath arrangement disclosed in PCT/US2014/064727.

Complete dissolution of a gas into a liquid is very important or essential for some applications. For example, if an oxygen-infused saline solution is to be injected into the bloodstream of a human or other animal, there cannot be any bubbles or nanobubbles that may be released from the saline solution once injected into the bloodstream as this may cause severe problems for the human or other animal. As another example, if oxygen is completely dissolved in an aqueous solution that is to be subjected to anaerobic digestion by microbes or bacteria, the dissolved oxygen becomes completely accessible to and usable by the microbes or bacteria, whereas if the oxygen is not completely dissolved in the form of nanobubbles it becomes less and less accessible and unusable by the microbes or bacteria, and once the nanobubbles acquire a size of 200 nm or more they becomes essentially inaccessible by the microbes or bacteria.

Use of the Stabilized Gas-Infused Liquid

Once a gas-infused liquid has been stabilized by being passed through the flowpath arrangement, it may be immediately used for any desired application, e.g., it can be produced on site at the location of a given application such that the stabilize, gas-infused liquid may be directly discharged into the application, or may be temporarily stored, possibly transported, and then discharged into the given application. Given the limited duration of the stability, however, it is most efficient to use it immediately after being stabilized.

In any event, when the stabilized, gas-infused liquid is being discharged from the flowpath arrangement 100 into a given application, e.g., flowing a stabilized, oxygen-infused aqueous solution into a waste treatment liquid pool, it is important that the stabilized, gas-infused liquid be discharged in as laminar of flow as possible so as not to create any shear in the discharged, stabilized, gas-infused liquid. Creation of shear would undesirably cause some of the infused gas to be released from the liquid.

Similarly, cavitation may be undesirably caused in the stabilized, gas-infused liquid by an outlet end of the flowpath if the end is not perfectly square, and/or if it has any obstructions associated therewith, such as burrs. Again, cavitation is very undesirable because it will undesirably cause some of the infused gas to be released from the liquid. In this regard, the present inventor has discovered that if the wall thickness of the tubing forming the outlet end of the flowpath 100 is reduced as much as possible, this will help to eliminate any cavitation in the in the stabilized, gas-infused liquid as it is discharged from the outlet end, and help the stabilized, gas-infused liquid to be discharged in as laminar of flow as possible. Thus, the outlet portion 105 of the flowpath arrangement 100 may have a reduced wall thickness in comparison to the remainder of the arrangement 100. For example, a ¼ inch ID metal tubing may have a reduced wall thickness of 0.047" or less. Further, the end portion could be tapered to have an size which gradually increases as it gets gets closer to outlet end. Such tapering is less important than reducing the wall thickness of the tubing forming the outlet end of the flowpath 100.

Although not shown, the present invention may further include a means for maintaining a temperature of the flow path arrangement. The temperature of the flow path can be maintained by, for example, a refrigeration device, a temperature control bath, a circulating heater/chiller, and/or immersing the flow path in a reservoir (e.g., a reservoir where the liquid is drawn from or where the stabilized, gas-infused liquid is discharged from the end of the flow path arrangement.

The stabilized, gas-infused liquid that is generated after passing a gas-infused liquid from the pressure vessel 12 through the flow path arrangement 100 may be used immediately by discharging the stabilized liquid from the arrangement 100 into any desired application, or the stabilized liquid may be temporarily stored for use at a later time, e.g., in an appropriately sized container such as a tank, cylinder, bottle, and at any appropriate temperature and pressure, which may include standard temperature (e.g., 20° C.) and pressure (e.g., 1 atmosphere). The stored liquid is preferably stored without a head space above the liquid in the container. For example, the liquid may be stored in a bladder that fills and/or expands with the addition of the gas liquid admixture, or any un-occupied space within a container may be adjustably filled by a compressible, or pressure-regulated bladder thereby eliminating open head space. In these examples, pressure about the bladder or provided by the bladder can be used to displace the gas liquid mixture from the container.

Applications for Gas-Infused Liquids

Again, there are many different purposes to which gas-infused liquids may be usefully applied, and the system 1 and flow path arrangement 100 according to the present invention enhance these uses and expand the number of possible uses because the resulting gas-infused liquids are more stable and may include larger amounts/percentages of infused gas than has been previously possible. The uses include direct treatment of the liquid by reaction with the gas or gasses infused therein or to be otherwise treated in a process promoted by the gas or gasses infused therein, such as bio remediation of waste water by infusing oxygen therein. These also include use of the the gas-infused liquids to achieve a desired condition, e.g., infusing carbon dioxide into water that will be subsequently applied for fire suppression, and creation of flexible solids or the like such as air-infused water which is subsequently frozen to form a flexible ice or using air-infused water in the preparation of a cement mixture which solidifies as flexible concrete (so-called flexcrete), etc. Other uses are less direct, such as when the gas-infused liquid is subsequently reacted with another liquid or substance in a process promoted by the gas or gasses infused therein, such as an aqueous solution which is to subsequently combined with a liquid hydrocarbon for removing solid matter from the hydrocarbon, e.g., admixing or injecting the stabilized, gas-infused liquid into: water containing oil and/or oil-water emulsions to promote separation of the hydrocarbons from the water; water containing dissolved salts and/or shale (fracking water) to promote precipitation of salts and/or shale from the fracking water; water containing suspended solids to promote separation of the suspended solids from the water; and various aqueous based solutions to change the pH thereof to facilitate separation of materials from the solutions by reaction, coagulation, polymerization, salt formation, crystallization, and/or effervescence as discussed in PCT/US2014/064727.

The stabilized, gas-infused liquid produced using flow path arrangement 100 according to the invention may be conveniently used at substantially any location because it can be stably stored and transported to any desired location, or may be generated on site at any desired location. Further, treatments effected using the gas-infused liquids may occur much more quickly than other possible treatments, e.g., bio-remediation treatments, or may be combined with such other treatments to enhance same.

When the gas-infused liquid is to be used for treating another liquid or substance, the stabilized, gas-infused liquid will preferably be combined with the other liquid or substance in a manner which little or no macro-bubble formation. For example, pressurized, oxygen-infused water may be injected below the surface in as laminar of flow as possible of a wastewater treatment pond which is at ambient conditions, and the oxygen-infused water will smoothly combine with the wastewater without forming any significant amount of macro-bubbles.

The foregoing description is given for clearness of understanding only, and no unnecessary limitations should be understood therefrom, as modifications within the scope of the invention may be apparent to those having ordinary skill in the art and are encompassed by the claims appended hereto.

For example, one possible modification would be when the liquid is highly viscous such as a cream. It is not practical to inject a highly viscous cream into the vessel 12 of the system 1 using a nozzle 20 as in the above discussed exemplary embodiment. Instead, a highly viscous cream may be simply pumped or injected into the vessel 12 without being sprayed, a gas would be hyperbarically infused into the cream by a high pressure maintained in the vessel, and after the cream is sufficiently infused with the gas it would be discharged from the vessel and then forced through the flowpath arrangement 100 at a sufficiently high pressure. The present inventor has, for example, passed a gas-infused cream of 20,000 Cp through a capillary size tubing.

What is claimed:

1. A system for generating liquid which is stably infused with gas, comprising:

a pressurized gas source; a pressurized liquid source;

an enclosed vessel into which the pressurized gas and pressurized liquid are injected such that the gas becomes infused into the liquid so as to generate a gas-infused liquid; and a fluid path into which the gas-infused fluid flows after being discharged from the vessel, wherein the fluid path includes multiple radially bent sections and multiple substantially straight sections fixed in a three dimensional (3D) arrangement such that the when the gas-infused liquid flows through the fluid path it is pressed inwardly of the 3D arrangement from multiple different directions to effect a multi-dense, orbital or spherical compaction of elements of the gas-infused liquid thereby forming the infused gas into nanobubbles in the gas-infused liquid, wherein the flow path arrangement is formed of tubing having having an inner diameter in a range of 0.5 mm-160 mm.

2. The system of claim 1, wherein the radially bent sections are configured to generate turbulent flow of the gas-infused liquid flowing therethrough, and the substantially straight sections are configured to generate laminar flow of the gas-infused liquid flowing therethrough.

3. The system of claim 1, wherein the substantially straight sections extend between adjacent ones of the radially bent sections along vectors having components in x, y, and z directions, whereby the gas-infused fluid flowing through the flow path is pressed inwardly of the 3D arrangement from multiple different directions as the fluid passes through the substantially straight sections and radially bent section.

4. The system of claim 1, wherein a collective total of the components in the z direction of all vectors of all of the substantially straight sections is about 360° or more.

5. The system of claim 1, wherein the substantially straight sections and the radially bent sections are alternately provided in the flow path arrangement.

6. The system of claim 4, wherein the flow path includes at least six of each of the substantially straight sections and the radially bent sections.

7. The system of claim 1, wherein the radially bent sections substantially orbitally or spherically surround a central portion of the 3D flow path arrangement.

8. The system of claim 1, wherein each of the radially bent sections causes a total change of direction of flow of the gas-infused aqueous liquid in a range of 60°-270°.

9. The system of claim 1, wherein the 3D flow path arrangement creates multi-dense bonding of elements of the gas-infused liquid through at least one of covalent, network covalent, ionic, polar, non-polar, and metallic bonding.

10. The system of claim 1, wherein a pressure inside the enclosed vessel is maintained in a range of 50-300 psi and a pressure inside of the 3D flow path arrangement is maintained in a range of 50-300 psi.

11. The system of claim 1, wherein the 3D flow path arrangement is formed of tubing having a circular cross-section.

* * * * *